US010586672B2

(12) United States Patent
Darr et al.

(10) Patent No.: US 10,586,672 B2
(45) **Date of Patent: *Mar. 10, 2020**

(54) PLUGGABLE TOUCH-SAFE FUSE MODULE WITH BUILT-IN REMOVAL HANDLE

(71) Applicant: EATON INTELLIGENT POWER LIMITED, Dublin OT (IE)

(72) Inventors: Matthew Rain Darr, Edwardsville, IL (US); Xuecheng Zhang, Shaanxi (CN); Rui Guo, Shaanxi (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/799,066

(22) Filed: Oct. 31, 2017

(65) Prior Publication Data

US 2018/0061606 A1 Mar. 1, 2018

Related U.S. Application Data

(63) Continuation of application No. 14/753,909, filed on Jun. 29, 2015, now Pat. No. 9,837,235, which is a continuation of application No. PCT/CN2014/081081, filed on Jun. 30, 2014.

(51) Int. Cl.

| | |
|---|---|
| ***H01H 85/165*** | (2006.01) |
| ***H01H 85/54*** | (2006.01) |
| ***H01H 85/153*** | (2006.01) |
| ***H01H 85/045*** | (2006.01) |
| ***H01H 85/12*** | (2006.01) |
| *H01H 9/10* | (2006.01) |

(Continued)

(52) U.S. Cl.
CPC ..... *H01H 85/165* (2013.01); *H01H 85/0452* (2013.01); *H01H 85/12* (2013.01); *H01H 85/153* (2013.01); *H01H 85/54* (2013.01); *H01H 9/10* (2013.01); *H01H 85/22* (2013.01); *H01H 85/30* (2013.01)

(58) Field of Classification Search
CPC .... H01H 85/165; H01H 85/54; H01H 85/153; H01H 85/30; H01H 85/22; H01H 9/10; H01H 85/0452; H01H 85/12
USPC ..... 337/201
See application file for complete search history.

(56) References Cited

U.S. PATENT DOCUMENTS

| | | | |
|---|---|---|---|
| 2,186,813 | A | 1/1940 | Adam |
| 3,202,788 | A | 8/1965 | George |
| 3,354,277 | A | 11/1967 | Stanback |

(Continued)

FOREIGN PATENT DOCUMENTS

| | | | |
|---|---|---|---|
| DE | 102005007225 | B4 | 8/2006 |

OTHER PUBLICATIONS

Written Opinion of the International Searching Authority for International Application No. PCT/CN2014/081081, dated Apr. 1, 2015, 8 pages.

*Primary Examiner* — Anatoly Vortman
(74) *Attorney, Agent, or Firm* — Armstrong Teasdale LLP

(57) ABSTRACT

A touch-safe fuse module includes a built-in slidable handle movable between extended and retracted positions relating to a housing of the fuse module. In the extended position, the handle assists with removal of the fuse from a base housing assembly by improving mechanical leverage to apply extraction force to the housing. Fuse modules having high current ratings may be effectively removed by hand without separately provided tools.

32 Claims, 7 Drawing Sheets

(51) Int. Cl.
*H01H 85/22* (2006.01)
*H01H 85/30* (2006.01)

(56) References Cited

U.S. PATENT DOCUMENTS

| | | | | |
|---|---|---|---|---|
| 4,488,767 | A * | 12/1984 | Lehman | H01H 85/547 337/213 |
| 5,406,449 | A | 4/1995 | Hicks | |
| 5,546,267 | A | 8/1996 | Frederiksen | |
| 5,973,418 | A | 10/1999 | Cieselka et al. | |
| 6,157,287 | A | 12/2000 | Douglass | |
| 6,366,449 | B1 * | 4/2002 | Hashizawa | H01H 9/10 337/194 |
| 6,373,370 | B1 | 4/2002 | Darr | |
| 6,456,187 | B2 * | 9/2002 | Konda | H01H 1/365 337/186 |
| 6,650,222 | B2 | 11/2003 | Darr | |
| 6,853,289 | B2 | 2/2005 | Scoggin | |
| 7,750,789 | B2 * | 7/2010 | Titokis | H01R 13/62944 337/194 |
| 7,893,809 | B2 * | 2/2011 | Head | H01H 85/54 337/194 |
| 8,098,126 | B2 | 1/2012 | Niedzwiecki | |
| 8,242,874 | B2 * | 8/2012 | Pavlovic | H01H 85/153 337/187 |
| 8,384,509 | B2 * | 2/2013 | Buettner | H01H 85/547 337/142 |
| 8,419,475 | B2 | 4/2013 | von zur Muehlen | |
| 9,613,776 | B2 * | 4/2017 | Brakefield | H01H 85/143 |
| 2013/0278375 | A1 | 10/2013 | Henricks | |

* cited by examiner

PLUGGABLE TOUCH-SAFE FUSE MODULE WITH BUILT-IN REMOVAL HANDLE

CROSS REFERENCE TO RELATED APPLICATIONS

This application is a continuation application of U.S. patent application Ser. No. 14/753,909 filed Jun. 29, 2015, which is a continuation application of International Application No. PCT/CN2014/081081.

BACKGROUND OF THE INVENTION

The field of the invention relates generally to electrical fuses, and more specifically to modular touch-safe fuses configured for plug-in connection and disconnection switching with a complementary base housing assembly.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuits through the fuse to prevent electrical component damage.

A variety of fusible disconnect switches are known in the art wherein fused output power may be selectively switched from a power supply via connections made and broken through the fuse terminals. Existing fusible disconnect switch devices, however, have not completely met the needs of the marketplace, and improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Exemplary fuse modules are described hereinbelow that overcome certain disadvantages in the art, Method aspects implementing advantageous features will be in part apparent and in part explicitly discussed in the description below.

Figure 1:
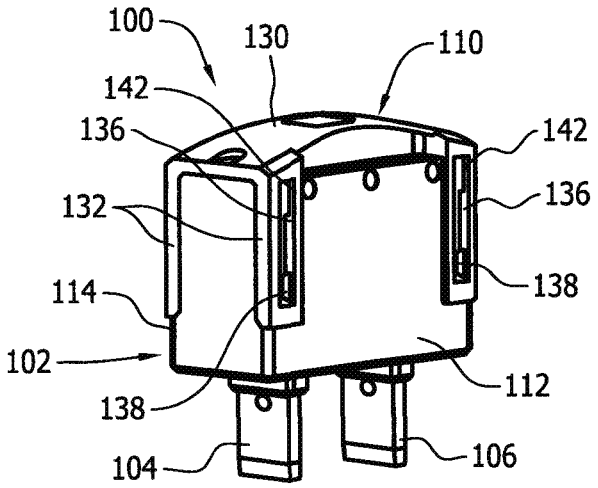
FIG. 1 is a perspective of a touch-safe fuse module including a built-in removal handle formed in accordance with an exemplary embodiment of the present invention.

FIG. 1 is a perspective of an exemplary touch-safe fuse module 100 including a built-in removal handle 110 formed in accordance with an exemplary embodiment of the present invention. The fuse module 100 is similar in some aspects to a CUBEFuse™ power fuse module commercially available from Bussmann by Eaton of St. Louis, Mo. The fuse module 100 is adapted, however, for high current applications that are beyond the capabilities of previously available CUBE-Fuse™ power fuse modules.

The fuse module 100 may be used in combination with a base housing assembly 200 (FIG. 8) that in the example shown is configured as disconnect switch housing assembly including a switch actuator 202 and an internal switch mechanism (not shown). In another embodiment, the switch actuator 202 and the switch mechanism may be considered optional and may be omitted, in which case the base housing assembly 200 functions simply as a fuse holder for the fuse module 100. It shall be understood, however, that even when the base housing assembly 200 is configured as a fuse holder, the circuit through the fuse holder can still be switched by insertion and removal of the fuse module 100. That is, when used with a fuse holder the fuse module 100 still provides a mode of switching the circuit and therefor the combination is still a type of disconnect switch. When the fuse module 100 is used with a disconnect switch housing assembly, additional modes of switching are realized that are independently operable from the pluggable switching mode of the fuse module 100.

The fuse module 100, as also shown in FIGS. 2-7, includes a touch-safe or finger-safe rectangular fuse module housing 102 having terminal blades 104, 106 projecting therefrom, and a fuse element assembly 108 (FIGS. 3 and 4) connected between the terminal blades 104, 106. The fuse element assembly 108 is designed to exhibit an ampacity rating of 200 A in one example.

The rectangular housing 102 of the fuse module 100 is fabricated from an electrically nonconductive or insulative material such as plastic. The housing 102 generally defines opposing longitudinal or major side walls 112 and 114 and opposing lateral or minor side walls 116, 118 interconnecting and arranged orthogonally with the major side walls 112, 114. The housing 102 further includes a bottom wall 120. The side walls 112, 114, 116, 118 and the bottom wall 120 define a fuse element cavity that receives the fuse element assembly 108.

The terminal blades 104, 106 are fabricated from conductive material and each extend from the bottom wall 120 of the housing 102. The terminal blades 104, 106 extend from the housing 102 in spaced apart but generally parallel planes extending perpendicular to the plane of the page of FIGS. 2 and 3. The terminal blades 104, 106 are generally aligned with one another as shown. Different arrangements of the terminals blades 104, 106 are possible in other embodiments. For example, one of the terminal blades 104, 106 could be oriented perpendicular to the other. As another example, one of the terminal blades 104, 106 could be staggered or offset relative to the other such that the terminal blades 104, 106 are not aligned on the housing 102.

The fuse element assembly 108 is located within the housing 102 and is electrically connected between the terminal blades 104, 106 to provide a current path therebetween. The fuse element assembly 108 in the example shown includes dual fuse elements that are designed to melt, disintegrate or otherwise structurally fail in response to specified electrical overcurrent conditions and permanently open the circuit path between the terminal blades 104, 106. When the fuse assembly 108 opens, load side electrical circuitry is electrically isolated from the line-side circuitry through the fuse 100 to prevent damage to load side circuitry and components that otherwise may occur. When the fuse element opens in such a manner, the fuse module 100 must be removed and replaced to restore affected circuitry. A variety of different types of fuse elements and fuse element assemblies are known and may be utilized in the fuse module 100 with considerable performance variations in use.

Figure 3:
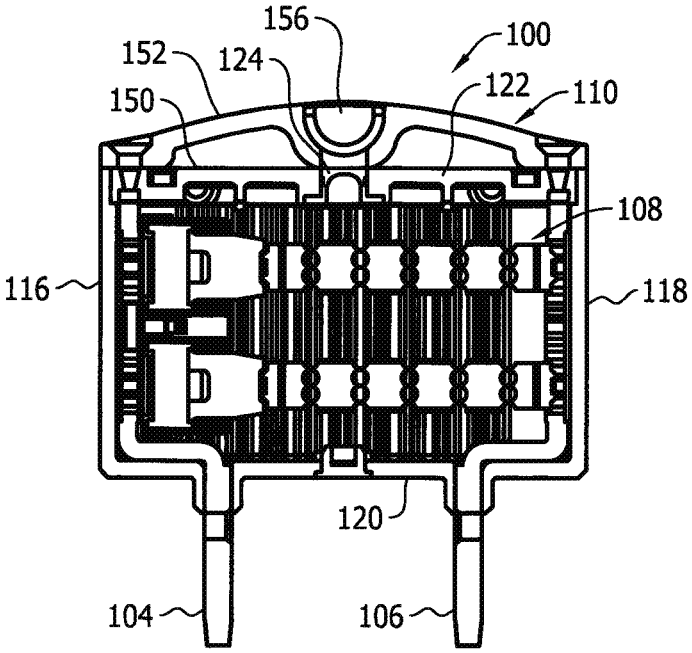
FIG. 3 is an enlarged view of the touch-safe fuse module shown in FIG. 2 with a portion of the housing shown transparent to reveal the internal construction of the touch-safe fuse module.
Figure 5:
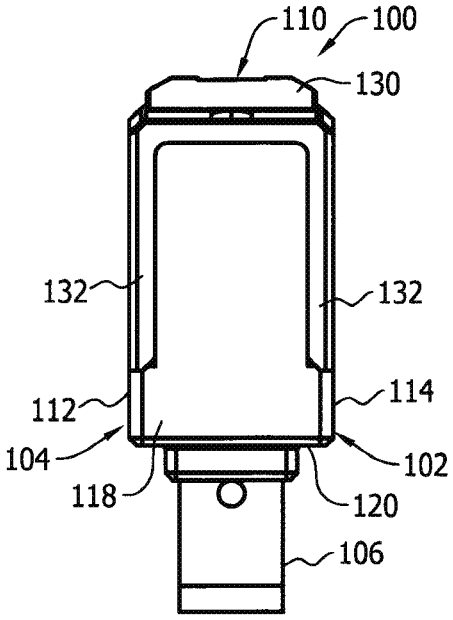
FIG. 5 is a side view of the touch-safe fuse module shown in FIG. 1-4.

Also, and as shown in the example illustrated, the fuse module 100 may include a top cover 122 and a fuse state indicator 124 (FIG. 3). A variety of fuse state indicators are known and may be utilized to provide local fuse state indicator to a person via visual inspection of the top cover 122. The fuse state indicator 124 identifies the permanent opening of the fuse element assembly 108 such that the fuse module 100 can be quickly identified for replacement via a visual change in appearance when viewed from the exterior of the fuse module 100. Such fuse state indication features may involve secondary fuse links or elements electrically connected in parallel with the primary fuse elements in the fuse element assembly 108. In some embodiments, the fuse state indicator 122 may be considered optional and may be omitted.

Figure 8:
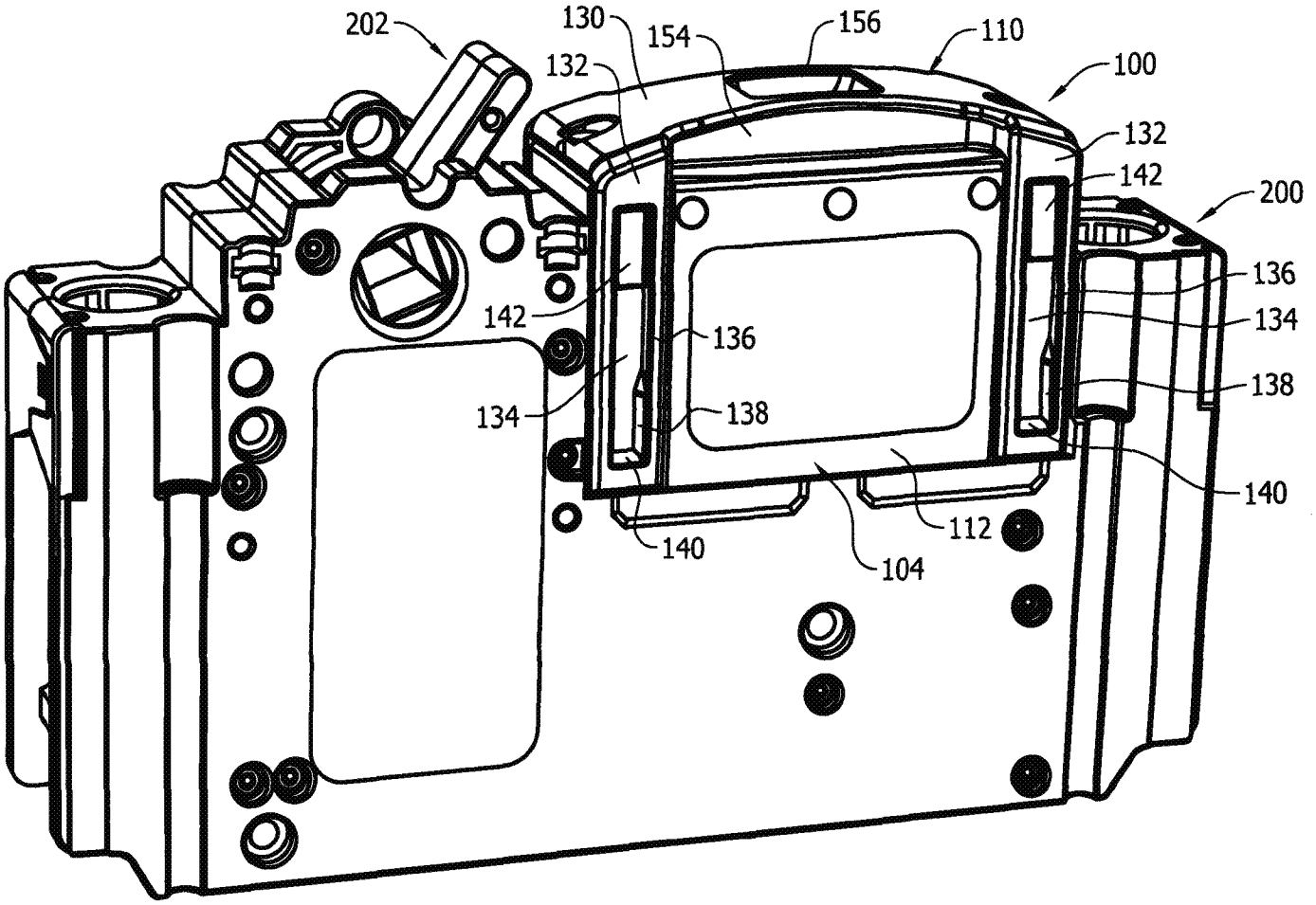
FIG. 8 shows the touch-safe fuse module plugged into a switch disconnect housing.

The ends of the terminal blades 104, 106 projecting from the housing. 102 may be received in pass through openings in the top of the base housing assembly 200 as shown in FIG. 8, such that the fuse module 100 can be plugged-in to the base housing assembly 200 or removed from the base housing assembly 200 by hand by grasping the rectangular fuse module housing 102 and either pushing it toward the base housing assembly 200 to engage the terminal blades 104, 106 to connecting terminals in the base housing assembly 200, or by pulling it away from the base housing assembly 200 to disengage the terminal blades 104, 106 from connecting terminals in the base housing assembly 200. Such an arrangement has been well received in the marketplace and one of its benefits is that it does not require conventional tools to engage or disengage conventional fasteners to remove or install the fuse module 104.

On occasion, however, the fuse modules 100 can be difficult to remove from the base housing assembly 200 by hand, especially when a number of base housing assemblies 200 and fuse modules 100 are arranged side-by-side such that physical access to grasp the fuse module housing 102 with ones fingers is limited. On other occasions, the force required to pull the fuse module 100 from the base housing assembly 200 is sufficiently great that certain persons may have difficulty removing the fuse module 100. Higher current power systems further require more substantial terminal blades and connecting structures in the base housing assembly 200, and accordingly greater insertion and extraction forces are required to install or remove the fuse module 100. The 200 A ampacity rating of the fuse module 100 well exceeds the ampacities of previously available CUBE-Fuse™ power fuse modules and thus the module 100 is not as easily handled as prior fuse modules designed with lower ampacity ratings.

Of course, the most problematic situations involve both restricted access and relatively high removal forces for any given fuse module 100. Separately provided tools are available to assist with removal of the modules in such situations, but this can be impractical when the proper tool is not at hand and inconvenient if the proper tool becomes misplaced, if the tool is somewhat difficult to use, or if the tool is not working properly.

The removal handle 110, built-in and provided on the fuse module 100, facilitates a more convenient removal of the fuse module 100 from the base housing assembly 200 when desired as explained below. One need not locate and use a separately provided fuse removal tool when access to the fuse housing 102 is limited, because the handle 110 is positionable relative to the fuse module housing 102 to extend away from the fuse module housing 102 and provide a clearance to grasp the handle 110 by hand. Thus, the handle 110 can be positioned to be accessible even when the fuse module housing 102 is not accessible, and one can grasp the extended handle 110 to remove the fuse module 100 rather than having to grasp the fuse housing 102. The handle 110 also provides improved mechanical leverage to assist with removal of the fuse module 100 as opposed to mere grasping of the fuse module housing 102 by hand. The removal handle 110 is integrated into the fuse module 100 and is attached to and carried on the exterior of the fuse module housing 102 so that it is always available for use when needed. The handle 110 is movable with simple sliding motion, providing a relatively low cost manufacture, yet highly reliable fuse removal feature. Reliability issues of conventional fuse puller devices having multi-piece constructions that pivot or rotate relative to one another to grip external surfaces of a fuse are avoided.

The handle 110 may be fabricated from an electrically insulative material such as plastic, and in the exemplary embodiment shown includes a grip section 130 and a plurality of legs 132 depending from the opposing ends of the grip section 130. Four legs 132 are shown in the embodiment illustrated in FIGS. 1-7. The legs 132 envelop the corners of the fuse housing 102 where the major sides 112, 114 and the minor sides 116, 118 meet. The fuse housing 102 is formed with recessed surfaces 134 that receive the handle legs 132. proximate the corners. The legs 132 extend from the handle grip portion 130 in a parallel manner to the recessed surfaces 134, and each leg 132 is slidable on the respective recessed housing surface 134. In the example shown in FIGS. 1-7, the legs 132 wrap around the housing corners and are in contact with both the major and minor side walls of the housing 102. As such, two of the handle legs 32 contact the first major side wall 112 and two of the handle legs 32 contact the second major side wall 114. Alternatively, two of the handle legs 32 contact the first minor side wall 116 and two of the handle legs 132 contact the second minor side wall 118. All of the legs 132 contact one major side wall 112 or 114 and one minor side wall 116 or 118 of the fuse housing 102.

In another embodiment, the handle legs 132 could contact either the major sides 112, 114 or minor sides 116, 118 of the housing 102, but not both. That is, the handle legs 132 need not wrap around the corners of the fuse module housing 102 as described above. For example, two of the legs 132 may contact only the first major side 112 and two of the legs may contact only the second major side 114. Alternatively, in another contemplated embodiment two of the legs 132 may contact only the first minor side 116 and two of the legs may contact only the second minor side 118. It is also recognized that the legs 132 need not extend at or near the corners of the fuse module housing 102 at all, but instead can be located elsewhere on the fuse module housing 102.

The handle legs 132 each define an elongated slot 136 extending linearly between a proximal end of each leg 132 where it attaches to the grip portion 130, and a distal end of each leg 132 that is distanced from the grip portion by a predetermined distance. The axial length of the slot 136 in each leg will determine its effective extension length when used to remove the fuse module 100 as explained below. A lower end of each slot 136 is constricted by tapered side ledges 138 extending inwardly into the slot 136. The lower end of each slot 136 is further constricted by a wedge-shaped catch element 140 (FIG. 8) extending upwardly into the slot 136. The tapered side ledges 138 and the catch element 140 reduce the width and length of the slot 136 at the lower end.

The side ledges 138 and the catch element 140 cooperate with elongated projections 142 formed in the housing 102. The projections 142 protrude from the housing recessed surfaces 134 near a top edge of the housing 102 and are dimensioned to constrain movement of the legs 132 relative to the housing 102 to essentially vertical movement only (i.e., toward the top of the page in FIGS. 1, 2 and 5). That is, the legs 132 can slide along the recessed surfaces 134 in a direction parallel to the axis of the recessed surfaces 134, which in turn is parallel to the longitudinal axis of the terminal blades 104, 106 and perpendicular to the housing bottom wall 120. The projections 142 preclude, however, the legs 132 from moving in a direction perpendicular to the longitudinal axis of the terminal blades 104, 106 and in a direction parallel to the housing bottom wall 120. Alternatively stated, the legs 132 are slidable only in a direction parallel to an axis 144 (FIG. 2) along which the fuse module 100 is inserted or removed from the base housing assembly 200. Such guided movement in one direction only maximizes mechanical leverage to remove the fuse 100 by pulling the terminal blades 104, 106 from the base housing assembly 200, as well as improves reliability of the handle 110 in use.

Figure 2:
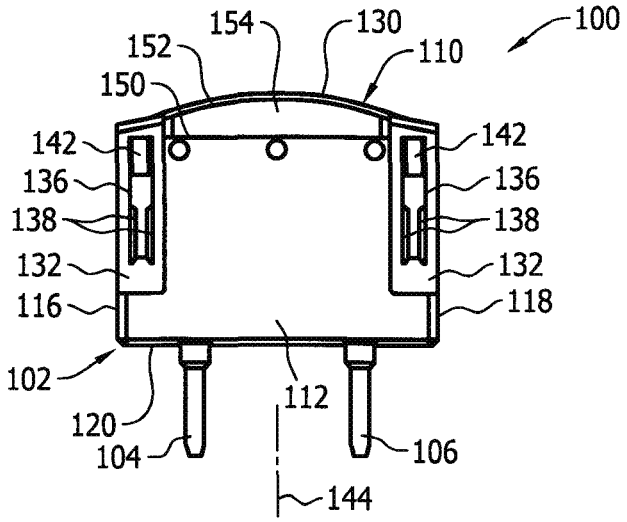
FIG. 2 is a front elevational view of the touch-safe fuse module shown in FIG. 1.
Figure 7:
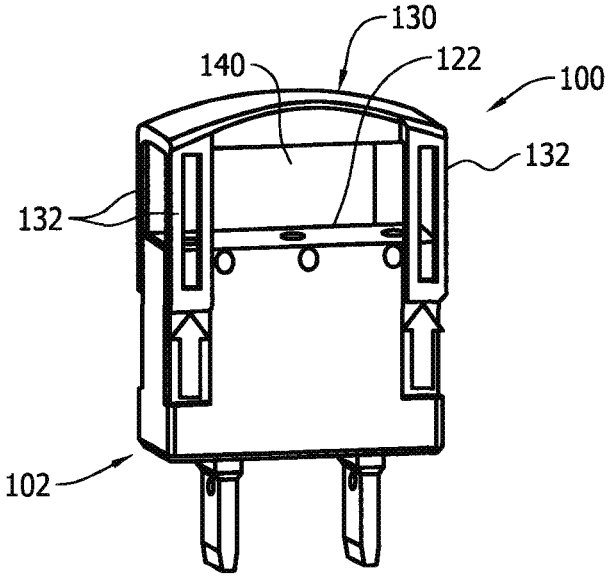
FIG. 7 is a view similar to FIG. 6 but showing a second stage of operation of the handle.

The handle 110 is slidably movable between a first, retracted position shown in FIGS. 1-3, 5 and 6 with the grip portion 130 lying on the top cover 122 of the fuse module 100, and a second, extended position with the grip portion 130 spaced from the top wall as shown in FIG. 7. In the extended position, a clearance 140 is created between the grip portion 130 and the top cover 122. In the extended position, one can wrap their fingers around the grip portion 130 and pull the handle grip portion 130 with ease along the axis 144 (FIG. 2). In the extended position, the ledges 138 and the catch element 140 in each leg 132 engage the housing projections 142. Positive latching between the handle legs 132 and the fuse module housing 102 is established when this occurs, providing a sturdy locking interface and mechanical coupling between the handle legs 132 and the fuse housing 102 to assist with removal of the fuse module 100. Such interlocking of the handle 110 at all four corners of the housing 102 provides uniform pulling force when the handle 110 is lifted as the user pulls the handle 110 further upward to unplug the fuse module 100 from the base housing assembly 200 with relative ease.

The handle grip portion 130 includes a flat lower surface 150 and a curved upper surface 152. The upper surface 152 has convex curvature that generally spans the top of the fuse module housing 102 from end to end measured along a dimension perpendicular to the minor side walls 116, 118. The upper surface 152 is raised from the lower surface 150 and the top of the fuse housing 102 in the center of the grip portion 130 to a maximum amount, and the upper surface 152 is gradually lowered toward the ends of the grip portion 130. The raised upper surface 152 is displaced from the flat top cover 122 of the fuse module 100 even when the handle 110 is in the retracted position. This allows access to the grip portion 130 even when the fuse housing 102 would otherwise be difficult to access.

The grip portion 130 is also tapered in the width dimension (i.e., the dimension perpendicular to the major side walls 112, 114) such that it is not as wide as the fuse housing 102. This allows a clearance from the side to grip the upper surface 132 and pull it upward from the retracted position. The handle grip portion 130 is also formed with a recess 154 below the curved upper surface 152 to further assist finger placement to lift the grip portion 130 from the retracted position to the extended position.

The grip portion 130 may also include an opening or aperture 156 such that the fuse state indicator 124 can still be seen through the handle 110 that would otherwise cover it. The aperture further allows the indicator 124 to be seen without having to move the handle 110. In embodiments wherein the fuse state indicator 124 is not provided, the opening 156 can be likewise considered optional and may not be provided.

Once the handle 110 is formed as described, it may be attached to the exterior surface of the fuse module housing 102 by flexing the legs 132 over the housing side walls until the housing protrusions 142 are received in the slots 136 formed in the legs 132. The slots 136 will guide the installation of the handle and when properly positioned the legs will snap into place. Once the handle 110 is installed the slots 136 and housing projections 142 cooperatively guide movement of the handle 110 between the extended and retracted position, and preclude movement in any other direction. The ledges 138 and catch elements 140 not only provide the mechanical coupling described above to assist with extraction force to remove the fuse from the base housing assembly 200, but effectively prevent the handle 110 from being removed from the fuse module housing 102 after its installation. The handle 110 generally cannot be lost or separated, and is always present and available for use for a user's convenience.

Figure 9:
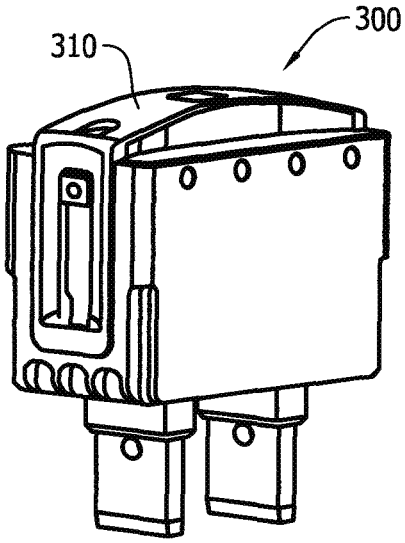
FIG. 9 is a perspective view of a second exemplary embodiment of a touch-safe fuse module.
Figure 10:
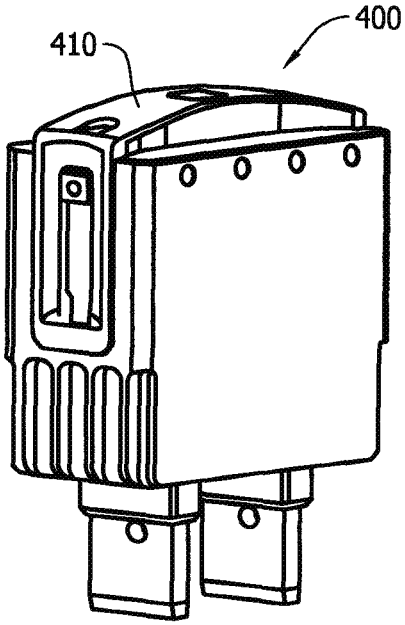
FIG. 10 is a perspective view of a third exemplary embodiment of a touch-safe fuse module.

FIGS. 9 and 10 illustrate touch-safe fuse modules 300, 400 having ampacity ratings of 400 A and 600 A respectively. While the size of the fuse modules 300 and 400 increases to accommodate the larger ampacity, the built-in handles 310 and 410 on the respective fuse modules 300, 400 are larger than the handle 110 hut are generally constructed and operate similarly to the handle 110 described above. Unlike the handle 110, only two legs are provided in the handles 310 and 410 that attach only to opposing lateral, minor side walls of the housing. The housings of the fuse modules 300, 400 are wider than the housing 102 of the fuse module 100 described above, so that additional clearance from the side is provided to facilitate gripping of the handle grip portion. The minor side walls include recessed sliding surfaces and projections similar to those described in the fuse module 100 described above. The handles 310 and 410 cooperate with the projections in the housings as described above in relation to the handle 110 and provide similar benefits.

Figure 4:
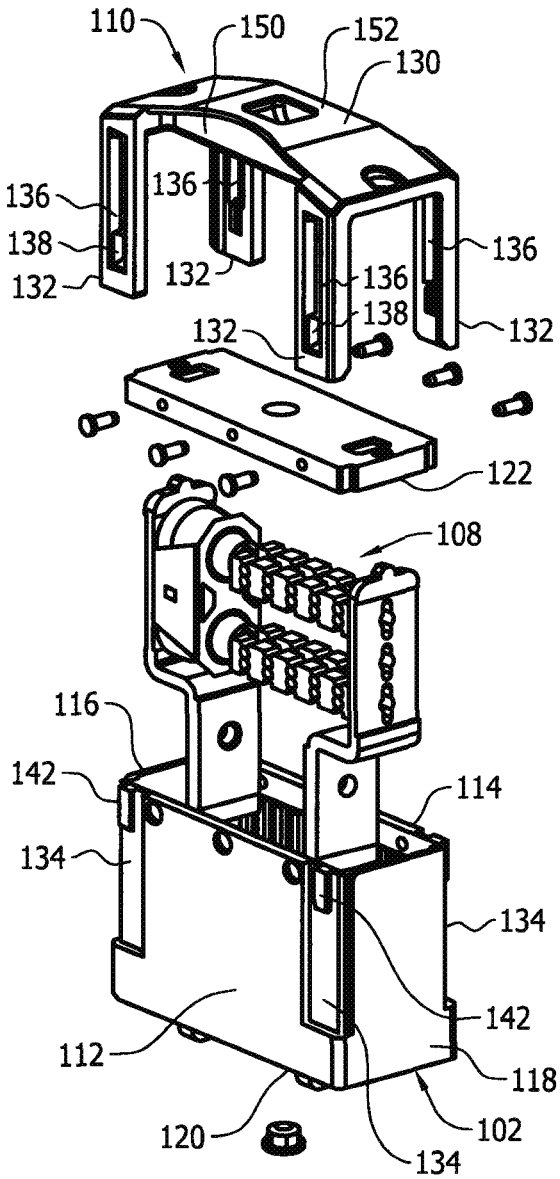
FIG. 4 is an exploded view of the touch-safe fuse module shown in FIGS. 1-3.
Figure 6:
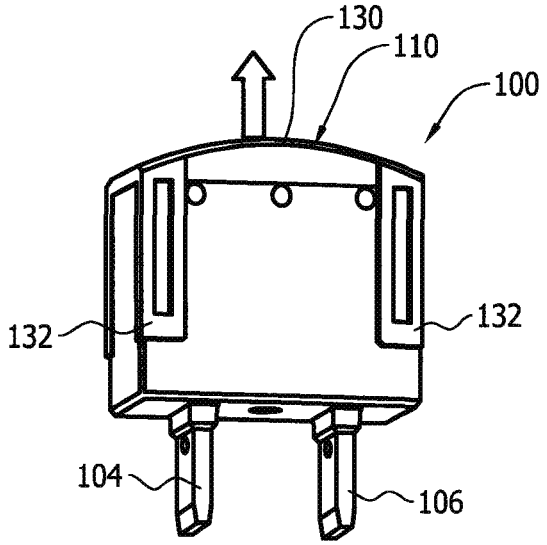
FIG. 6 is a another perspective view of the touch-safe fuse module shown in FIGS. 1-5 and showing a first stage of operation of the handle.
Figure 11:
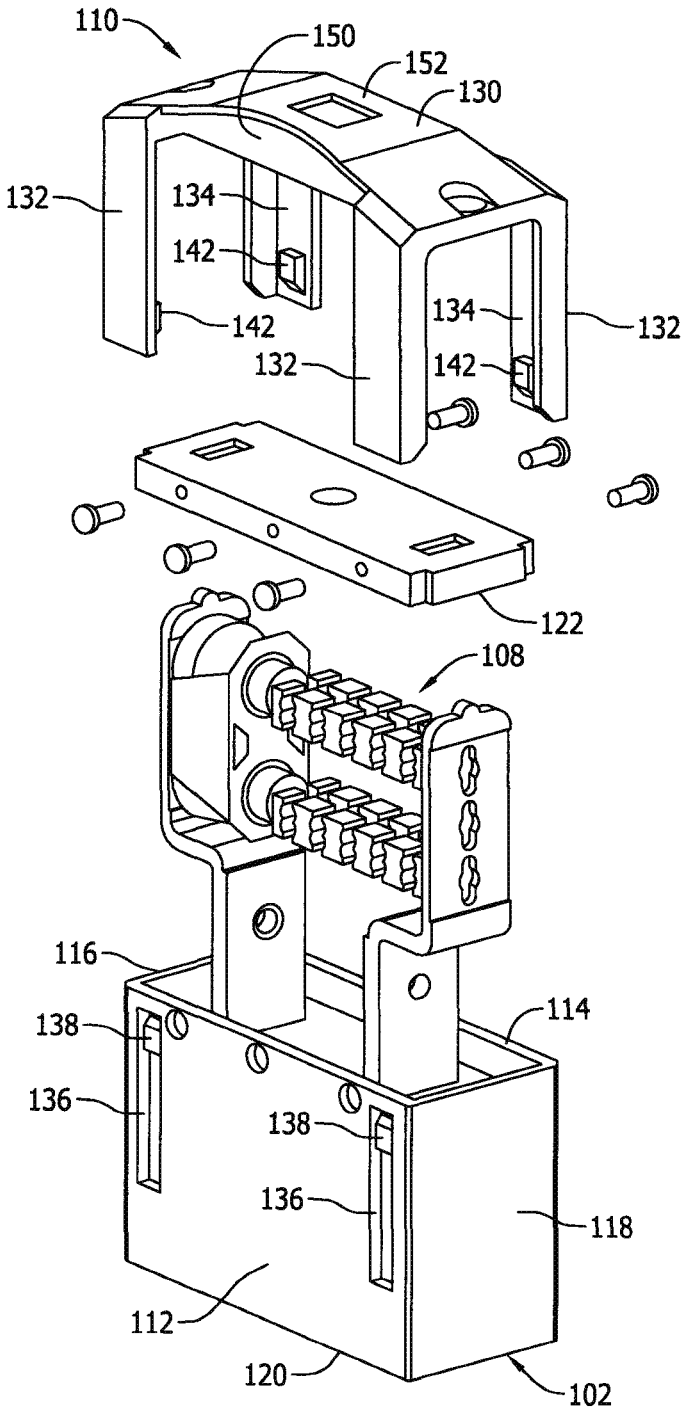
FIG. 11 is an exploded view of a fourth exemplary embodiment of a touch-safe fuse module.

FIG. 11 is an exploded view of another embodiment of a touch-safe module that is similar to the touch-safe fuse module shown in FIG. 4, but includes elongated slots 136 formed in the exterior of the housing 102, and projections 142 formed on the legs 132 of the removal handle 110. Like the touch-safe fuse module shown in FIG. 4, in the touch-safe fuse module shown in FIG. 11 the engagement of the projections 142 and the elongated slots 132 constrain movement of the legs 132 relative to the housing 102 to essentially vertical movement only. Such guided movement in one direction only maximizes mechanical leverage to remove the fuse 100 by pulling the terminal blades 104, 106 from the base housing assembly 200, as well as improves reliability of the handle 110 in use.

The benefits and advantages of the inventive concepts discloses are now believed to have been amply illustrated in relation to the exemplary embodiments disclosed.

An exemplary embodiment of a touch-safe fuse module has been disclosed including: a housing having an exterior surface; first and second terminal blades projecting from the housing; at least one fuse element connected between the first and second terminal blades; and a handle attached to the exterior surface of the housing and slidably movable relative to the exterior surface between a first position and a second position assisting with removal of the fuse.

Optionally, the handle may include a grip portion and at least first and second legs depending from the grip portion. Each of the first and second legs may define an elongated guide slot. The housing may define first and second projections, with each of the pair of projections received in the elongated slot in respective ones of the first and second legs. An end of each elongated slot may be constricted to engage one of the pair of projections when the handle is in the second position. The pair of projections may each be elongated. The handle may include third and fourth legs depending from the grip portion.

The housing may include a plurality of side walls, and the first and second legs may be attached to the same one of the side walls. The first and second legs may likewise be attached to different ones of the plurality of side walls. The first and second legs may be attached to a first one of the plurality of side walls, and the third and fourth legs may be attached a second one of the plurality of side walls. The first and second legs may attach to respective corners of the housing.

The housing may include a top surface, and the grip portion may extend across the top surface. The top surface of the housing may be flat, and the grip portion may include a curved upper surface. The upper surface of the grip portion may be spaced from the top surface when the handle is in the first position. The grip portion may include opposing upper and lower surfaces, with the lower surface lying upon the housing when the handle is in the first position. The lower surface may be spaced from the housing when the handle is in the second position.

The housing may include a top surface, and the touch-safe fuse module may further include a fuse state indicator visible on the top surface. The grip portion may include an opening revealing the fuse state indicator when the handle is in the first position. The housing exterior may be formed with at least a first recessed surface and a second recessed surface, and a portion of the handle may be received in each of the first and second recessed surfaces. The housing may include a plurality of side walls, and the first and second recessed surfaces may be formed on different ones of the plurality of side walls. The housing may include a plurality of side walls and a plurality of corners, and the first and second recessed surfaces may be formed adjacent the corners. The housing may be formed with a first projection on the first recessed surface and a second projection on the second recessed surface, wherein each of the first and second projections is received in a portion of the handle. The first and second projections may be formed on different ones of the plurality of side walls. The first and second projections are formed adjacent the corners of the housing.

One of the housing exterior and the handle may define at least one elongated slot, and the other of the exterior surface and the handle may define at least one elongated projection, with the at least one elongated projection being received in the at least one slot and providing guided motion of the handle along a single axis. The handle may include a grip portion and at least one leg, with the at least one elongated slot provided in the at least one leg. The at least one leg may include a plurality of legs, and each of the plurality of legs may be provided with an elongated slot. The at least one projection may be provided on the housing, wherein the at least one projection is located proximate a corner of the housing. The exterior surface further defines at least one recessed surface, the projection extending from the at least one recessed surface. The housing may have a first width and the grip portion may have a second width, the second width being less than the first width.

Another embodiment of a touch-safe fuse module has also been disclosed comprising: a housing having an exterior surface; first and second terminal blades projecting from the housing; at least one fuse element connected between the first and second terminal blades; and a handle attached to the exterior surface of the housing in at least two locations, wherein the handle is slidably movable relative to the exterior surface at the at least two locations between a first position lying on the housing and a second position establishing a clearance from the housing; wherein at least one of the housing exterior and the handle defines a slot at the first and second location; wherein at least one of the housing exterior and the handle defines a projection at the first and second location; and wherein the projections and slots at the first and second locations are mechanically interlocked when the handle is in the second position to assist with generating a fuse removal force.

Optionally, the handle may define the slot at the first location. The housing exterior may define the slot at the first location. The slot may be elongated. The projection may be elongated. The housing may include a plurality of side walls, and the first location and the second locations may be on different ones of the plurality of side walls. The housing exterior may define a first recessed surface and a second recessed surface, and a portion of the handle may be received in each of the first recessed surface and the second recessed surface. The handle may include a curved grip portion. The grip portion may include an aperture, wherein a portion of the fuse module is visible through the aperture.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A touch-safe fuse module comprising:

a single housing having a bottom wall and opposing longitudinal side walls and opposing lateral side walls interconnecting and arranged orthogonally with the longitudinal side walls, the longitudinal side walls and the lateral side walls collectively defining an exterior surface;

first and second terminal blades projecting perpendicularly from the bottom wall of the single housing, the first and second terminal blades having a longitudinal axis;

at least one fuse element connected between the first and second terminal blades; and a built-in removal handle attached to the exterior surface of the single housing at a plurality of locations and slidably movable upon the exterior surface at the plurality of locations along a single axis in a direction parallel to the longitudinal axis of the first and second terminal blades, the built-in removal handle positionable relative to the exterior surface in a first position and a second position assisting with removal of the touch-safe fuse module from a base housing assembly that engages the first and second terminal blades, the built-in removal handle comprising a grip portion and first and second legs depending from the grip portion and respectively attaching to the exterior surface of the single housing at one of the plurality of locations;

wherein at each of the plurality of locations the exterior surface of the single housing or the built-in removal handle defines an elongated slot, and the other of the exterior surface of the single housing or the built-in removal handle defines an elongated projection; and wherein at each of the plurality of locations the elongated projection is received in the elongated slot, thereby providing guided motion of the built-in removal handle along the single axis.

2. The touch-safe fuse module of claim 1, wherein the elongated guide slot is defined in the first and second legs at the respective plurality of locations.

3. The touch-safe fuse module of claim 2, wherein the elongated projection is defined on the exterior surface at the respective plurality of locations.

4. The touch-safe fuse module of claim 1, wherein the plurality of locations includes a first location on one of the opposing longitudinal side walls of the single housing and a second location on the other of the opposing longitudinal side walls of the single housing.

5. The touch-safe fuse module of claim 1, wherein the built-in removal handle further comprises third and fourth legs depending from the grip portion.

6. The touch-safe fuse module of claim 5, wherein the first and second legs are attached to a one of the opposing longitudinal side walls of the single housing, and wherein the third and fourth legs are attached to the other of the opposing longitudinal side walls of the single housing.

7. The touch-safe fuse module of claim 1, wherein the first and second legs are attached to respective corners of the single housing where respective ones of the opposing longitudinal side walls and the opposing lateral side walls interconnect.

8. The touch-safe fuse module of claim 1 wherein the single housing further includes a top surface, and a fuse state indicator visible on the top surface of the single housing.

9. The touch-safe fuse module of claim 8, wherein the grip portion includes an opening revealing the fuse state indicator when the built-in removal handle is in the first position.

10. The touch-safe fuse module of claim 1, wherein the exterior surface of the single housing is formed with at least a first recessed surface and a second recessed surface, a portion of the first leg being received in the first recessed surface and a portion of the second leg being received in the second recessed surface.

11. The touch-safe fuse module of claim 10, wherein the first recessed surface and second recessed surface are formed on different ones of the longitudinal and lateral side walls of the single housing.

12. The touch-safe fuse module of claim 10, wherein the first recessed surface and second recessed surface are formed adjacent respective corners of the single housing where respective ones of the opposing longitudinal side walls and the opposing lateral side walls interconnect.

13. The touch-safe fuse module of claim 1, wherein the elongated guide slot is is defined on the exterior surface at the respective plurality of locations.

14. The touch-safe fuse module of claim 2, wherein the elongated projection is defined in the first and second legs at the respective plurality of locations.

15. The touch-safe fuse module of claim 1, wherein the first and second terminal blades respectively extend in spaced apart, parallel planes.

16. A touch-safe fuse module comprising:

a housing having an exterior surface including opposing longitudinal side walls and opposing lateral side walls interconnecting and arranged orthogonally with the longitudinal side walls;

first and second terminal blades projecting perpendicularly from a bottom wall of the housing, wherein at least the first terminal blade extends in a plane that is spaced from but generally parallel to one of the opposing lateral side walls;

at least one fuse element connected between the first and second terminal blades; and a built-in removal handle attached to the exterior surface of the housing in at least two locations, wherein the built-in removal handle is slidably movable relative to the exterior surface at the at least two locations between a first position lying on the housing and a second position establishing a clearance from the housing;

wherein the housing exterior or the built-in removal handle defines a slot at each the first location and second location;

wherein the housing exterior or the built-in removal handle defines a projection at each of the first location and second location; and wherein the projection and slot at the first location and second location is mechanically interlocked when the built-in removal handle is in the second position to assist with generating a fuse removal force.

17. The touch-safe fuse module of claim 16, wherein the built-in removal handle defines the slot at the first and second locations.

18. The touch-safe fuse module of claim 16, wherein the housing exterior defines the projection at the first and second locations.

19. The touch-safe fuse module of claim 16, wherein the first location and the second location are on different ones of the opposing longitudinal side walls and opposing lateral side walls.

20. The touch-safe fuse module of claim 16, wherein the exterior surface defines a recessed surface at each of the first location and the second location, and a portion of the built-in removal handle being received in each recessed surface.

21. The touch-safe fuse module of claim 16, wherein the built-in removal handle includes a curved grip portion.

22. The touch-safe fuse module of claim 21, wherein the grip portion includes an aperture, wherein a portion of the fuse module is visible through the aperture when the built-in removal handle is in the first position.

23. The touch-safe fuse module of claim 16, wherein the built-in removal handle defines the projection at the first and second locations.

24. The touch-safe fuse module of claim 16, wherein the housing exterior defines the slot at the first and second locations.

25. A touch-safe fuse module comprising:

a housing having an exterior surface including opposing longitudinal side walls and opposing lateral side walls interconnecting and arranged orthogonally with the longitudinal side walls, first and second terminal blades extending in spaced relation but generally parallel to one of the opposing longitudinal side walls and opposing lateral side walls and a fuse element connected between the first and second terminal blades; and a built-in removal handle slidably movable relative to the exterior surface in at least two locations and selectively positionable between a retracted position and an extended position establishing a clearance from the exterior surface of the housing;

wherein at the first of the at least two locations, the exterior surface or the built-in removal handle defines a slot;

wherein at the second of the at least two locations, the exterior surface or the built-in removal handle defines a projection; and wherein at each of the at least two locations the projection and the slot is mechanically interlocked when the built-in removal handle is in the extended position to assist with generating a fuse removal force.

26. The touch-safe fuse module of claim 25, wherein the exterior surface defines a slot at the first of the at least two locations, and the built-in removal handle defines a projection at the first of the at least two locations.

27. The touch-safe fuse module of claim 25, wherein the exterior surface defines a projection at the second of the at least two locations, and the built-in removal handle defines a slot projection at the second of the at least two locations.

28. A touch-safe fuse module comprising:

a single housing having a bottom wall, opposing longitudinal side walls, and opposing lateral side walls interconnecting and arranged orthogonally with the longitudinal side walls, the longitudinal side walls and the lateral side walls collectively defining an exterior surface;

first and second terminal blades projecting perpendicularly from the bottom wall of the single housing, the first and second terminal blades having a longitudinal axis;

at least one fuse element connected between the first and second terminal blades; and a built-in removal handle attached to the exterior surface of the single housing at a plurality of locations and slidably movable upon the exterior surface at the plurality of locations along a single axis in a direction parallel to the longitudinal axis of the first and second terminal blades, the built-in removal handle positionable relative to the exterior surface in a first position and a second position assisting with removal of the touch-safe fuse module from a base housing assembly that engages the first and second terminal blades, the built-in removal handle comprising a grip portion and first and second legs depending from the grip portion and respectively attaching to the exterior surface of the single housing at one of the plurality of locations;

wherein at each of the plurality of locations the exterior surface of the single housing defines an elongated slot, and the built-in removal handle defines an elongated projection; and wherein at each of the plurality of locations the elongated projection is received in the elongated slot, thereby providing guided motion of the built-in removal handle along the single axis.

29. The touch-safe fuse module of claim 28, wherein the first and second terminal blades respectively extend in spaced apart, parallel planes.

30. A touch-safe fuse module comprising:

a single housing having a top cover, a bottom wall and a plurality of side walls extending between the top cover and the bottom wall, the plurality of side walls collectively defining an exterior surface;

first and second terminal blades projecting from the bottom wall of the single housing, the first and second terminal blades having a longitudinal axis;

at least one fuse element connected between the first and second terminal blades; and a built-in removal handle comprising:

a grip portion overlying the top cover and including first and second ends; and a first leg depending from the grip portion at the first end;

a second leg depending from the grip portion at the second end; and a third and fourth legs respectively depending from the first and second ends of the grip portion;

each of the first and second legs extending parallel to a portion of the exterior surface and being slidably attached thereto, and the third and fourth legs overlying a portion of the exterior surface and being slidably attached thereto;

wherein the first second, third and fourth legs are movable upon the exterior surface along a single axis in a direction parallel to the longitudinal axis of the first and second terminal blades to extend the built-in removal handle to a pulling position wherein the grip portion is spaced from the top cover.

31. The touch-safe fuse module of claim 30, wherein the first and second terminal blades respectively extend in spaced apart, parallel planes.

32. The touch-safe fuse module of claim 30, wherein one of the exterior surface and the first and second legs defines a slot, and wherein the other one of the exterior surface and the first and second legs defines a slot defines a projection, and wherein the projection is received in the slot to provide guided motion of the built-in removal handle along the single axis.

* * * * *